US005682140A

United States Patent [19]

Christensen et al.

[11] Patent Number: 5,682,140

[45] Date of Patent: Oct. 28, 1997

[54] IMAGE FORMING DEVICE WITH END OF LIFE MESSAGING FOR CONSUMABLES

[75] Inventors: K. Trent Christensen; Douglas A. Cheney, both of Boise, Id.

[73] Assignee: Hewlett-Packard Company, Palo Alto, Calif.

[21] Appl. No.: 651,221

[22] Filed: May 22, 1996

[51] Int. Cl.[6] ..... G08B 21/00

[52] U.S. Cl. ..... 340/540; 340/635; 340/653; 340/691

[58] Field of Search ..... 340/540, 635, 340/653, 691

[56] References Cited

U.S. PATENT DOCUMENTS

| | | | |
|---|---|---|---|
| 4,390,872 | 6/1983 | Murakami et al. | 340/691 |
| 4,520,354 | 5/1985 | Umeda et al. | 340/691 |
| 4,586,034 | 4/1986 | Nakamine | 340/691 |

*Primary Examiner*—Glen Swann

[57] ABSTRACT

A method of and an apparatus for communicating with the operator that of an image forming device which reduces the probability of error in acquiring a replacement consumable and which alerts the operator as to the proper disposal of the exhausted consumable. The invention utilizes status sensors within the printing device to sense when a particular consumable is exhausted or nearing exhaustion. The printing device automatically prints a hard copy page for the operator informing the user of the status of the particular consumable and corrective action to be taken. This is accomplished by a firmware implementation within the image forming device where in addition to, or in lieu of, a traditional low level status light indicator, the low level sensor sets a flag within the firmware program of the printing device which causes one or more pages of information to be printed from the image forming device. This information can be completely prestored within a memory device such as a ROM (read only memory) or NVRAM (non-volatile random access memory) either within the image forming device or on the consumable itself, or, the message can be generated at least partially in a dynamic fashion depending upon the type of consumable consumed and other use factors.

4 Claims, 2 Drawing Sheets

IMAGE FORMING DEVICE WITH END OF LIFE MESSAGING FOR CONSUMABLES

FIELD OF THE INVENTION

This invention generally relates to image forming devices and more particularly to an apparatus and method for informing an operator of an image forming device that one or more consumable components of the device is approaching the end of its life.

BACKGROUND OF THE INVENTION

Most image forming devices, such as facsimile machines, printers and copiers, utilize any number of consumables, e.g. toner, ink, ribbon, photoconductor, developer, etc., which need to be replaced at the end of their lives. The service life for a consumable is generally designed by the manufacturer and is monitored by the print engine in which it operates. Optimally, near the end of the consumable's life, the print engine displays a message to the user on the front panel of the device or on a host device, such as a personal computer, concerning the status of the consumable. Some image forming devices simply activate an error or alarm light to indicate that something with the device needs to be corrected, sometimes displaying an error code.

Some printing and coping devices have a consumable status annunciation light or indicator which alerts the operator of the exhaustion of the consumable. These indicator messages usually appear on a printer front panel or may, in rare cases, appear on the host computer that the device is connected to. The message is generally very limited, usually consisting of nothing more than a "toner low" or "service" indicator. The user must decide what consumable to replace and must find the model number and any other required information in the user documentation. As is oftentimes the case, the documentation for use and maintenance of the printing device are hard to find or lost altogether. If more than one printing device is in the same area, locating the correct documentation can be difficult and confusing.

The level of communication with the user is very limited, leaving the user to determine what consumables to secure to continue operation. Furthermore, with the proliferation of printing and copier device models, most offices have a number of different model numbers of varying capability and age. The low level of communication, coupled with the large number of device makes and models, has made reordering and recycling consumables both difficult and frustrating for the operator. One example of this is that manufacturers receive a large number of toner cartridges returned under warranty with the toner sealing tape not removed, in other words, they were never installed or used. These products were purchased erroneously and had to be exchanged for the correct model. Purchasing the correct consumable can be a challenge. Disposing of the exhausted consumable can also be frustrating.

Also, because of the way in which the consumables are marketed, it is very difficult for the to manufacturer gather information directly from the operators of the consumable products. More often than not, the consumable products are retailed through large distributors. Consequently, manufacturers have attempted to gain information directly from the consumer by including product survey cards with the new consumable products. Unfortunately, the participation rates for these kinds of surveys are quite low in comparison to the total number of products sold. It is very easy for the consumer to discard the survey card with the packaging and not send it in. This tendency also lowers participation in recycling programs for the consumables since it is easy to lose or throw away the mailing labels and other packaging.

Accordingly, it would be advantageous to provide more direct communication with the operator regarding the need to obtain and install replacement consumables. Additionally, it would be advantageous to solicit user input at times other than those at which a replacement consumable is being installed to circumvent the tendency for the user to discard the solicitation.

SUMMARY OF THE INVENTION

This invention employs a method of communicating with the printing device operator which reduces the probability of error by the operator in acquiring a replacement consumable and which informs the operator as to the proper disposal of the exhausted consumable. The invention advantageously utilizes the status sensors of the printing device which are typically built into the print engine of the printing or image forming device. When the status indicator senses that a particular consumable is exhausted or nearing exhaustion, the printing device automatically prints a hard copy page for the operator informing the user of the status of the particular consumable and corrective action to be taken. This hard copy page can provide the operator with information concerning a number of different issues which may include: ordering or purchasing instructions; consumables model number; stock keeping unit number; product number; consumable type; color; size; quantity; accessories such as printer accessories, paper, etc.; recycling instructions; installation instructions; and even print a recycling shipping label as part of the instructions. Other information could also be printed as desired.

This is accomplished, in the preferred embodiment, using a firmware implementation within the image forming device. In addition to, or in lieu of, a traditional low level status light indicator, the low level sensor sets a flag within the firmware program of the printing device which causes one or more pages of information to be printed by the image forming device. The information contained in these pages can be completely prestored within a memory device such as a ROM (read only memory) or NVRAM (non-volatile random access memory) either within the image forming device or on the consumable itself, or, the message can be generated at least partially in a dynamic fashion depending upon the type of consumable consumed and other use factors. For example, using the bi-directional Centronics printer connection, the printer driver software or even application software can generate one or more pages of information to the user in response to a "low toner signal", for example, from the print engine. This information could contain past usage information to predict future use and thereby instruct the operator on the quantity of this particular consumable to keep on hand. Additionally, a survey card or sheet could be printed using user information already contained within the host device such as user name and address, computer type, number of consumables consumed since purchase date, number of pages printed since last consumable, average consumable life, etc.

The primary benefit to the owner/operator of the image forming device is improved and on-going communication from the manufacturer on issues related to owning and using the particular image forming device. These issues include matters such as replacement and disposal of the exhausted consumable as well as marketing promotions, product upgrades, documentation changes, new product releases, etc. The hard copy page or pages can be hand carried by the operator to the place of purchase for the consumable. This eliminates the need for the operator to reference the documentation for the printing device. Additionally, the hard copy page can be printed in the operators own language. This can be triggered from the language selection on the printing device control panel or within an attached host device. Also, the message can be easily custom tailored to contain promotional material for a particular supplier or distributor of the consumable.

Often operators are confused about what to do with the consumable when it is exhausted. Due to environmental sensitivity, many regret disposing of the exhausted consumable in the landfill. Many manufacturers have recycling programs but often the operator is not aware of the program. For example, every new Hewlett-Packard cartridge has a pre-paid United Parcel Service shipping label with the installation instructions inside the box. Unfortunately, oftentimes operators throw away the shipping material, instructions and label. However, by including the recycling information in the end-of-life hard copy page, the operator has one more opportunity to understand about the recycling program.

Customers desire as little interaction with the printer as possible. Receiving a hard copy page of instructions at the end of cartridge life reduces the need to look up information in the user manuals.

DETAILED DESCRIPTION OF THE INVENTION

Figure 1:
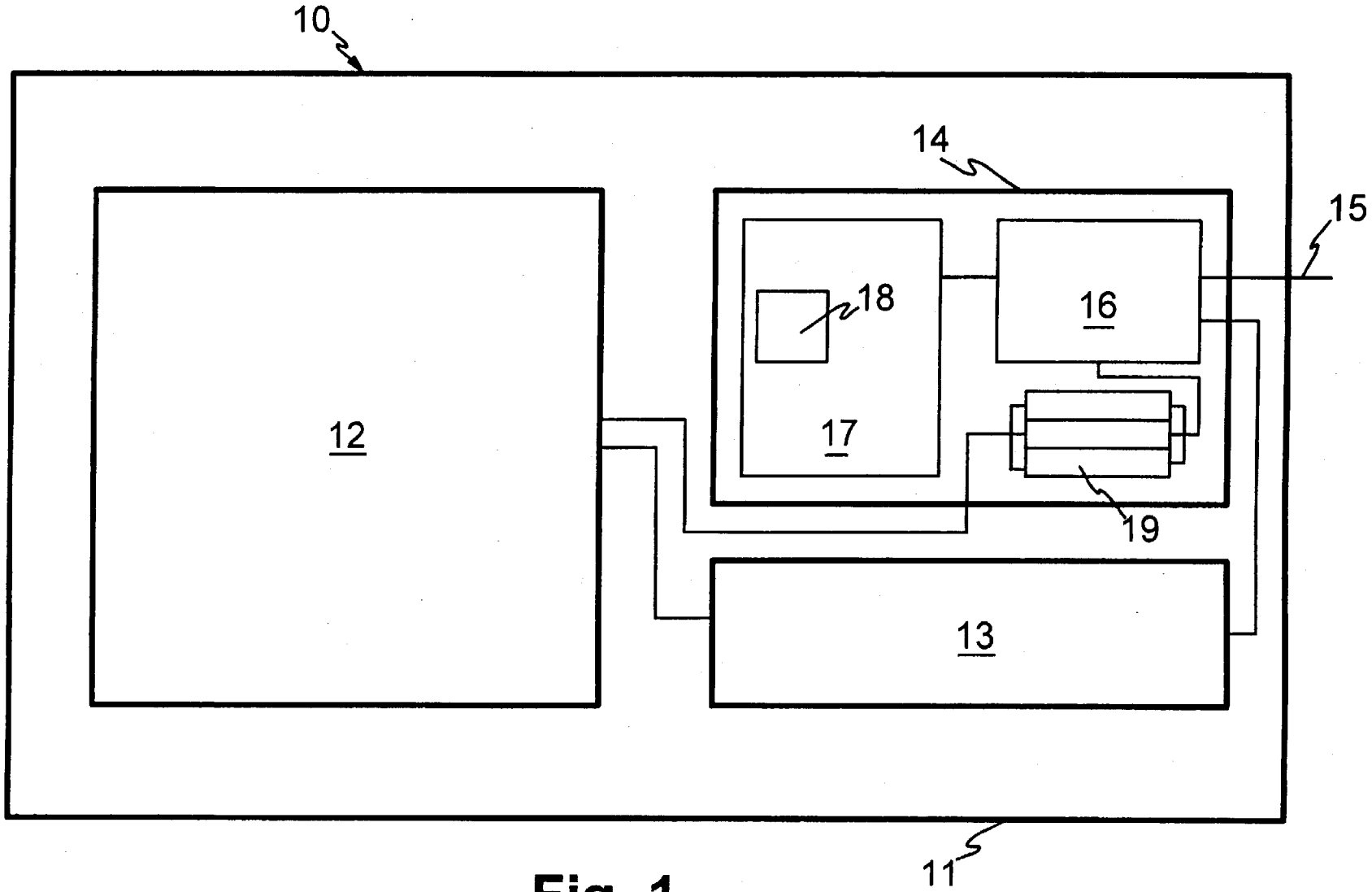
FIG. 1 is schematic representation of an image forming device incorporating the consumable end of life messaging feature of the invention.

Referring now to the figures, an image forming device 10 is shown in schematic representation in FIG. 1. While this representation is indicative of a laser type printer it should be understood that the invention is not so limited and is applicable to other image forming devices such as facsimile machines, thermal printers, impact printers, ink jet printers and virtually any other kind of image forming device which uses expendable components to create the images. The laser printer example has been adopted for the sake of convenience and understanding only. Hence, any references to a laser printer, printing device or other specific printer references are intended to refer and apply to the broad category of image forming devices which employ expendable components to render images.

Image forming device 10 includes a housing 11 to house its various electronic components. In general terms, those electronic components include a print engine 12, a printer controller 13, a formatter 14 and an input 15 for receiving data to be printed. In the case of a document printer such as a laser printer, the print engine 12, which is the device which actually affixes the image to the print media, fixes or fuses one or more toner components to the print media to create the image. Printer controller 13 provides the supporting electronic control for the print engine and provides an interface to the print engine. In the case of a laser print engine, printer controller 13 modulates the laser for photoconductor exposure, sets the relative bias voltages and fuser temperatures, etc. Additionally, printer controller 13 interprets signals received from print engine 12 such as the toner low signal which is used in this preferred embodiment to trigger the hard copy notification feature of the present invention, really just providing a higher level interface for formatter 14 which ultimately controls how the print engine acts.

Formatter 14 includes a microprocessor 16, which is programmed by firmware 17, such as a read only memory module (ROM), and a strip output buffer 19. A portion 18 of the memory or firmware 17 is used in two embodiments of the invention: one in which a page representation of the page to be printed is stored in memory 18; and another in which control codes, i.e. programming instructions, are stored to instruct microprocessor 16 to dynamically create the page representation responsive to a low consumable status condition received from print engine 12, printer controller 13 or some other device which monitors the condition of a consumable component. In this later case, the instructions stored in memory are still a "representation" of a hard copy page to be printed, only on a higher level of abstraction in the sense that the actual page creation can be more flexible as to the content of the page and thereby custom tailor the content to match the consumable condition or to convey some other desired message to the user.

Figure 2:
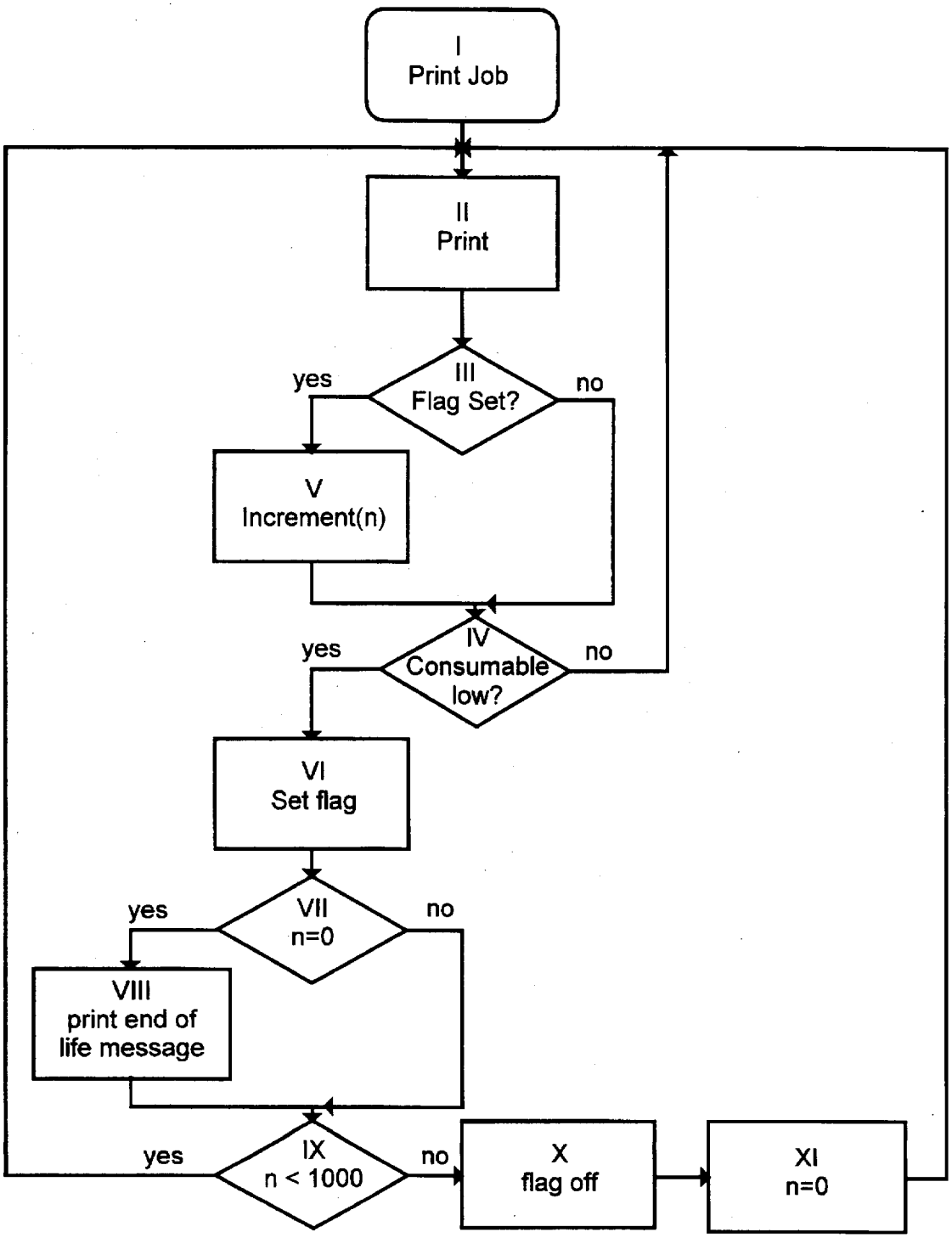
FIG. 2 is flow chart showing one possible firmware implementation for the invention.

FIG. 2 shows one possible flow diagram for the control software necessary to implement the invention in the printer firmware to print a message at the end of the life of a toner cartridge. In this particular implementation, the firmware first checks to see if the "end-of-life message" flag is set in step III. For the purposes of this explanation, assume that the consumable in question is just now approaching the end of its life and therefor the end-of-life message flag is not yet set. This being the case, the firmware program then asks whether or not the consumable is low, step IV. If not, the program loops back up to the top. If a low condition is sensed, the program sets the end-of-life message flag in step VI. Next, in step VII, the program checks the value of a counter, here "n", which is used to prevent consecutive printings of the end of life message page. The first time through this portion of the loop, "n" is equal to zero so the end-of-life message is printed, step VIII. Next the program asks if "n" is less than 1000, step IX. This last step is used to print the end-of-life message only once per toner cartridge and assumes that no more than 1000 pages could be printed from a toner cartridge after a "toner low" status signal was generated by the print engine. This feature allows an operator to remove and shake a low toner cartridge without generating a new end-of-life printed message. The next time through the loop, because the message flag is set, "n" is incremented at step V, causing the end-of-life message to not be printed in the current and subsequent loops. This continues until "n" equals 1000, at which time the message flag is reset and "n" is initialized to zero. By this time, a new cartridge has been installed and the entire process starts over.

While there is shown and described the preferred embodiment of the invention, it is to be distinctly understood that this invention is not limited thereto but may be variously embodied to practice within the scope of the following claims.

What is claimed is:

1. An image-forming device which comprises:

a housing;

a print engine residing within the housing;

at least one sensor for sensing a status condition for a consumable; and a printed page generator coupled to the sensor and responsive to the sensed status condition to generate data and transmit this data to the print engine to print a printed page containing a status message indicative of the sensed status condition.

2. The image forming device of claim 1 further comprising a formatter being electrically connected to the print engine, the formatter including a portion of memory and wherein the printed page generator includes a portion of the memory being configured to contain a representation of a printed page indicative of the sensed status condition.

3. The image forming device of claim 1 further comprising a portion of memory being electrically connectable to the print engine and wherein the printed page generator includes a portion of the memory being configured to contain a representation of a printed page indicative of the sensed status condition.

4. A method of notifying an operator of an image forming device having exhaustible consumables, comprising the steps of:

sensing a status condition for a printer consumable; and printing a page with the image forming device responsive to the sensed status condition and containing a status message indicative of the sensed status condition.

* * * * *